US007681668B2

(12) United States Patent
Oxford et al.

(10) Patent No.: US 7,681,668 B2
(45) Date of Patent: Mar. 23, 2010

(54) SHRINK-FIT SLEEVE ASSEMBLY FOR A DRILL BIT, INCLUDING NOZZLE ASSEMBLY AND METHOD THEREFOR

(75) Inventors: James Andy Oxford, Magnolia, TX (US); John H. Stevens, Spring, TX (US); James L. Duggan, Friendswood, TX (US); Redd H. Smith, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 210 days.

(21) Appl. No.: 11/731,245

(22) Filed: Mar. 30, 2007

(65) Prior Publication Data

US 2008/0236899 A1 Oct. 2, 2008

(51) Int. Cl.
*E21B 10/61* (2006.01)

(52) U.S. Cl. ..... 175/340; 175/339; 175/393

(58) Field of Classification Search ..... 175/339, 175/340, 393, 424
See application file for complete search history.

(56) References Cited

U.S. PATENT DOCUMENTS

| | | | | | |
|---|---|---|---|---|---|
| 3,823,789 | A | * | 7/1974 | Garner | 175/340 |
| 3,923,324 | A | | 12/1975 | Cruickshank et al. | |
| 3,938,853 | A | | 2/1976 | Jurgens et al. | |
| 3,945,446 | A | * | 3/1976 | Ostertag et al. | 175/323 |
| 3,952,819 | A | | 4/1976 | Adcock | |
| 4,381,825 | A | | 5/1983 | Radtke | |
| 4,494,618 | A | | 1/1985 | Radtke | |
| 4,542,798 | A | * | 9/1985 | Madigan | 175/340 |
| 4,666,001 | A | | 5/1987 | Burr | |
| 4,687,067 | A | | 8/1987 | Smith et al. | |
| 5,678,645 | A | | 10/1997 | Tibbitts et al. | |
| 5,829,539 | A | * | 11/1998 | Newton et al. | 175/393 |
| 6,142,248 | A | * | 11/2000 | Thigpen et al. | 175/340 |
| 6,655,481 | B2 | | 12/2003 | Findley et al. | |
| 7,040,423 | B2 | | 5/2006 | Larsen et al. | |
| 7,048,081 | B2 | | 5/2006 | Smith et al. | |
| 2006/0266557 | A1 | * | 11/2006 | Estes | 175/340 |

FOREIGN PATENT DOCUMENTS

| | | |
|---|---|---|
| GB | 2122670 | 1/1984 |

OTHER PUBLICATIONS

International Search Report for International Application No. PCT/US2008/003321 mailed July 24, 2008 (4 pages).
Written Opinion of the International Searching Authority for International Application No. PCT/US2008/003321 mailed Jul. 24, 2008 (6 pages).

* cited by examiner

*Primary Examiner*—Giovanna C Wright
(74) *Attorney, Agent, or Firm*—TraskBritt

(57) ABSTRACT

A shrink-fit sleeve assembly comprising a bit body includes at least one sleeve port with a substantially tubular sleeve disposed therein and interferingly engaged therewith. The sleeve port includes an internal surface of substantially circular cross-section, and the tubular sleeve includes an internal nozzle port and an external surface of substantially circular cross-section. A lateral dimension of an external surface is equal to or greater than a first dimension at ambient temperature. A nozzle assembly and a method of manufacturing or retrofitting a drill bit are also disclosed.

28 Claims, 4 Drawing Sheets

SHRINK-FIT SLEEVE ASSEMBLY FOR A DRILL BIT, INCLUDING NOZZLE ASSEMBLY AND METHOD THEREFOR

FIELD OF THE INVENTION

The invention, in various embodiments, relates to drill bits for subterranean drilling and, more particularly, to a shrink-fit sleeve in a drill bit, including a nozzle assembly therefor and a method of manufacturing or retrofitting drill bits with the sleeve.

BACKGROUND OF THE INVENTION

Drill bits for subterranean drilling, such as drilling for hydrocarbon deposits in the form of oil and gas, conventionally include internal passages for delivering a drilling fluid, or "mud," to locations proximate a cutting structure carried by the bit. In fixed cutter drill bits, or so-called "drag" bits, the internal passages terminate proximate the bit face at locations of nozzles received in the bit body for controlling the flow of drilling mud used to cool and clean the cutting structures (conventionally polycrystalline diamond compact (PDC) or other abrasive cutting elements). Some drill bits, termed "matrix" bits, are fabricated using particulate tungsten carbide infiltrated with a molten metal alloy, commonly copper-based. Other drill bits, termed "cemented" bits, are fabricated by sintering particulate tungsten carbide and a metal or metal alloy, commonly cobalt- or nickel-based. Still other drill bits comprise steel bodies machined from blanks, billets or castings. Steel body drill bits are susceptible to erosion from high pressure, high flow rate drilling fluids, on both the face of the bit and the junk slots as well as internally. As a consequence, on the bit face and in other high-erosion areas, hardfacing is conventionally applied. Within the bit, erosion-resistant components such as nozzles and inlet tubes fabricated from tungsten carbide or other erosion-resistant materials are employed to protect the steel of the bit body. "Matrix" bits and "cemented" bits are less susceptible to this erosion, but still require nozzles for creating desired fluid flow parameters. The nozzles, regardless of the material used in the bit body, allow fluid flow to be specified or selected to obtain various flow rates and patterns.

As shown in FIG. 7 of the drawings, a conventional steel body drill bit 500 for use in subterranean drilling may include a plurality of nozzle assemblies, exemplified by illustrated nozzle assembly 501. While many conventional drill bits use a single piece nozzle, the nozzle assembly 501 is a two piece replaceable nozzle assembly, the first piece being a tubular tungsten carbide inlet tube 502 that fits into an internal fluid port or passage 504 machined in the body of the drill bit 500, and is seated upon an annular shoulder 505 of port 504. The second piece is a tungsten carbide nozzle 503 that may have a restricted bore 513 that is secured within port 504 of the drill bit 500 by threads which engage mating threads 506 on the wall of port 504. The inlet tube 502 is retained in port 504 by abutment between the annular shoulder 505 and the end of the nozzle 503. The inlet tube 502 and the nozzle 503 are used to provide protection to the material of the steel body drill bit 500 through which port 504 extends against erosive drilling fluid effects by providing a hard, abrasion- and erosion-resistant pathway from an inlet fluid chamber or center plenum 507 within the bit body to a nozzle exit 508 located proximate to an exterior surface of the bit body. The inlet tube 502 and nozzle 503 are replaceable should the drilling fluid erode or wear the parts within internal passage 509 extending through these components, or when a nozzle 503 having a different orifice size is desired; however, it is intended that the inlet tube 502 and nozzle 503 will protect the material of the bit body surrounding the internal fluid port 504 from all erosion. Further, the outer surface or wall of the nozzle 503 is in sealing contact with a compressed O-ring 514 disposed in an annular groove formed in the wall of port 504 to provide a fluid seal between the steel body drill bit 500 and the nozzle 503.

In order to retain the nozzle 503 within the port 504 of the steel body drill bit 500, the threads 506 must necessarily be of high quality and machined to desired tolerances. Obtaining the desired machined threads 506 is readily obtainable in a drill bit made from steel material. However, obtaining the desired quality threads with the required tolerances in a bit composed of a material, such as a "cemented" carbide, for example, requires forming or machining the threads prior to final sintering of the bit body material. The volumetric change that occurs during the sintering process may ultimately lead to distortion or lower quality of threads, which may require further post-sintering processing which increase the cost of manufacturing.

Accordingly, it is desirable to provide for threaded attachment of a nozzle in which the precision tolerances may be obtained by a threaded attainment regardless of the material selected for the body of the drill bit. Also of advantage would be to provide a threaded attachment that is achievable after the bit body is substantially manufactured, particularly for bit bodies manufactured by sintering or infiltration processes. It is also desirable to provide for a threaded nozzle attachment that allows for standardized nozzles to be used therewith. A further advantage would be to provide a nozzle assembly of a design that may be suitable for either replacement and retrofit applications for existing drill bits, as well as in the manufacture of new drill bits, without requiring complicated and costing manufacturing or remanufacturing techniques.

BRIEF SUMMARY OF THE INVENTION

In one embodiment, a shrink-fit sleeve assembly is provided which provides for a threaded attachment of a nozzle in which the precision tolerances may be obtained by threaded attainment regardless of the material selected for the body of the drill bit. The shrink-fit sleeve provides an attachment interface for the nozzle, eliminating the need for precision dimensional control of the complementary geometry within the body of the drill bit during manufacture.

Another embodiment comprises a sleeve compressively retained in a bit body after the bit body is manufactured by a sintering process. The sleeve eliminates dimensional sensitivities otherwise associated with manufacturing of a bit body by a sintering process.

A shrink-fit sleeve assembly includes a bit body having at least one sleeve port with a substantially tubular sleeve interferingly disposed therein. The sleeve port has an internal surface that is substantially circular in cross-section and, the tubular sleeve includes an internal nozzle port and an external surface which is substantially circular in cross-section. A lateral dimension of the external surface is equal to or greater than the lateral dimension of the internal surface of the sleeve port, taken along the same cross-section, at ambient temperature. The internal and external surfaces may be substantially cylindrical or substantially frustoconical in shape.

A nozzle assembly is provided in embodiments of the invention.

In other embodiments, a method of manufacturing or retrofitting a drill bit is also provided.

In still further embodiments, a compressively retained part assembly having increased retention force therein is provided, including a method of enhancing the retention force between two compressively interfering parts.

Other advantages and features of the invention will become apparent when viewed in light of the detailed description of the various embodiments of the invention when taken in conjunction with the attached drawings and appended claims.

DETAILED DESCRIPTION OF THE INVENTION

Figure 1:
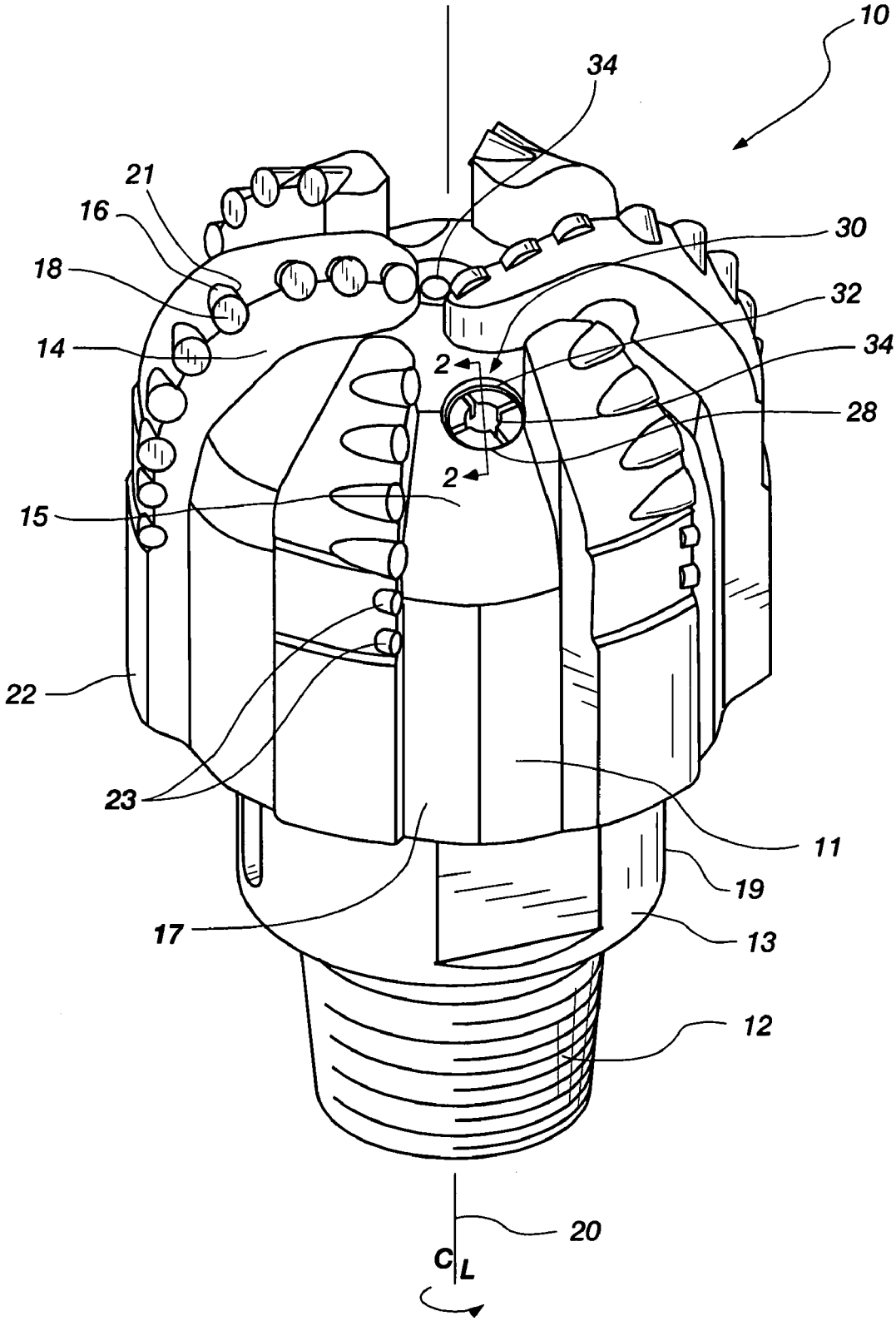
FIG. 1 shows a perspective, inverted view of a drill bit incorporating a nozzle assembly according to an embodiment of the invention.

In the description which follows, like elements and features among the various drawing figures are identified for convenience with the same or similar reference numerals.

FIG. 1 shows a drill bit 10 incorporating a plurality of nozzle assemblies 30 according to one or more embodiments of the invention. The drill bit 10 is configured as a fixed-cutter rotary full bore drill bit, also known in the art as a "drag bit." The drill bit 10 includes a bit crown or body 11 composed of sintered tungsten carbide coupled to a support 19. The support 19 includes a shank 13 and a crossover component (not shown) coupled to the shank 13 in this embodiment of the invention by using a submerged arc weld process to form a weld joint therebetween. The crossover component (not shown), which is manufactured from a tubular steel material, is coupled to the bit body 11 by pulsed MIG process to form a weld joint therebetween in order to allow the complex tungsten carbide material to be securely retained to the shank 13. It is recognized that the support 19, particularly for other materials used to form a bit body, may be made from a unitary material piece or multiple pieces of material in a configuration differing from the shank 13 being coupled to the crossover or support 19 by weld joints as presented. The shank 13 of the drill bit 10 includes conventional male threads 12 configured to API standards and adapted for connection to a component of a drill string, not shown. The face 14 of the bit body 11 has mounted thereon a plurality of cutting elements 16, each comprising polycrystalline diamond (|PCD|) table 18 formed on a cemented tungsten carbide substrate. The cutting elements 16, conventionally secured in respective cutter pockets 21 by brazing, for example, are positioned to cut a subterranean formation being drilled while the drill bit 10 is rotated under weight on-bit (WOB) in a bore hole about the centerline 20. The bit body 11 may include gage trimmers 23 including the aforementioned PCD tables 18 configured with a flat edge aligned parallel to the rotational axis 20 of the bit (not shown) to trim and hold the gage diameter of the bore hole, and gage pads 22, which contact the walls of the bore hole to maintain the hole diameter and stabilize the bit in the hole.

During drilling, drilling fluid is discharged through nozzle assemblies 30 located in sleeve ports 28 in fluid communication with the face 14 of bit body 11 for cooling the PCD tables 18 of cutting elements 16 and removing formation cuttings from the face 14 of drill bit 10 into passages 15 and junk slots 17. The nozzle assembly 30 in this embodiment includes a substantially tubular sleeve 32, a nozzle 34 and an O-ring seal (not shown) that may be received within a sleeve port 28 of the bit body 11. The nozzle 34 may be sized for different fluid flow volumes and velocities depending upon the desired flushing required at each group of cutting elements 16 to which a particular nozzle assembly directs drilling fluid. The inventive nozzle assembly of the invention may be utilized with new drill bits, or with drill bits that are appropriately modified and refurbished after use in the field. Use of a nozzle assembly 30 with a drill bit 10 as described herein enables removal and installation of nozzles in the field, and mitigates unwanted washout or erosion of the nozzle assembly 30, including the components of the nozzle assembly 30 that may be caused by drilling fluid flow. An additional advantage of a nozzle assembly 30 used in conjunction with a drill bit 10 as described herein is in providing a means of establishing desired geometries and tolerances within the nozzle ports that are extremely difficult to obtain, if not impossible, because of shrinkage effects that are otherwise observed and manifested during manufacturing when sintering to obtain essentially full density in a bit body that has been machined in an unsintered state.

The bit crown or body 11 of the drill bit 10 may be formed from cemented carbide that may be coupled to the tubular crossover or support 19 by welding, brazing, soldering or other bonding techniques known by a person of skill in the art, for example, after a forming and sintering process and is termed a "cemented" bit. The cemented carbide in this embodiment of the invention comprises tungsten carbide particles in a metal-based alloy matrix made by pressing a powdered tungsten carbide material, a powdered metal-based alloy material and admixtures, which may comprise a lubricant and organic additives such as wax, into what is conventionally known as a "green" body. As used herein, the term "metal-based alloy," wherein may be any metal, means commercially pure metal in addition to metal alloys wherein the weight percentage of metal in the alloy is greater than the weight percentage of any other component of the alloy. A green body is relatively fragile, having enough strength to be handled for limited shaping operations, subsequent furnacing or sintering, but often not strong enough to handle impact or other stresses imparted by machining processes necessary to prepare the green body into a finished product. In order to make the green body strong enough for particular processes, the green body is then partially sintered into what is conventionally known as a "brown state," as known in the art of particulate or powder metallurgy, to obtain a brown body suitable for machining, for example. In the brown state, the brown body is not yet fully densified, but exhibits compressive strength suitable for more rigorous manufacturing processes, such as machining, while exhibiting a material state advantageous for obtaining features in the body that are not practicably obtained during forming or are more difficult and costly to obtain after the body is fully densified. Thereafter, the brown body is sintered to obtain a fully dense cemented bit.

As an alternative to tungsten carbide, one or more of diamond, boron carbide, boron nitride, aluminum nitride, tungsten boride and carbides, nitrides and borides of Ti, Mo, Nb, V, Hf, Zr, Ta, Si and Cr may be employed. Optionally, the matrix material may be selected from the group of iron-based alloys, nickel, nickel-based alloys, cobalt, cobalt-based alloys, cobalt- and nickel-based alloys, aluminum-based alloys, copper-based alloys, magnesium-based alloys, and titanium-based alloys. While the material of the body 11 as described may be made from a tungsten carbide with a cobalt matrix, other materials suitable for use in a bit body may also be utilized.

After the body is fully densified, post-machining process of boring may be used to obtain the final cylindrical shape of a sleeve port described below. In order to facilitate the post-machining process, displacements, as known to those of ordinary skill in the art, may be utilized during final sintering to nominally control the shrinkage, warpage or distortion of pre-machined cylindrical features placed into the pre-densified body. While displacements may help to achieve nominal dimensions of the sleeve ports 28 during final sintering of some materials thereby lessening the extent to which post-machining is required, invariably, critical component features, such as threads, are not suitably obtainable in the fully densified body within the high degree of tolerances required. Furthermore, grinding or other machine operations are required in order to obtain critical component features, such as threads, in the fully densified body. The invention discussed herein robustly provides for obtaining critical component features regardless of whether a displacement is used during the manufacturing process and without the need for a post-densification grinding of the sintered material to achieve dimensional accuracy of the critical component feature.

While the drill bit 10 of this embodiment of the invention is a cemented bit, a drill bit in accordance with embodiments of the invention may include a matrix bit or a steel body bit as are well known to those of ordinary skill in the art, for example, without limitation. Drill bits, termed "matrix" bits, and as noted above are fabricated using particulate tungsten carbide infiltrated with a molten metal alloy, commonly copper-based. The advantages of the invention mentioned herein for "cemented" bits apply similarly to "matrix" bits. Steel body bits, again as noted above, comprise steel bodies generally machined from bars or castings, and may also be machined from forgings. While steel body bits are not subjected to the same manufacturing sensitivities as noted above, steel body bits may enjoy the advantages of the invention obtained during manufacture, assembly or retrofitting as described herein.

Figure 2:
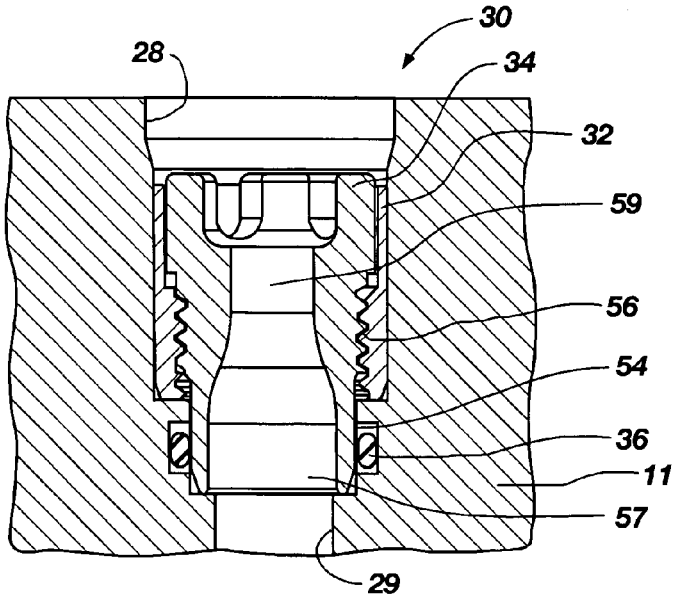
FIG. 2 shows a cross-sectional view of the nozzle assembly in the drill bit as shown in FIG. 1.
Figure 3:
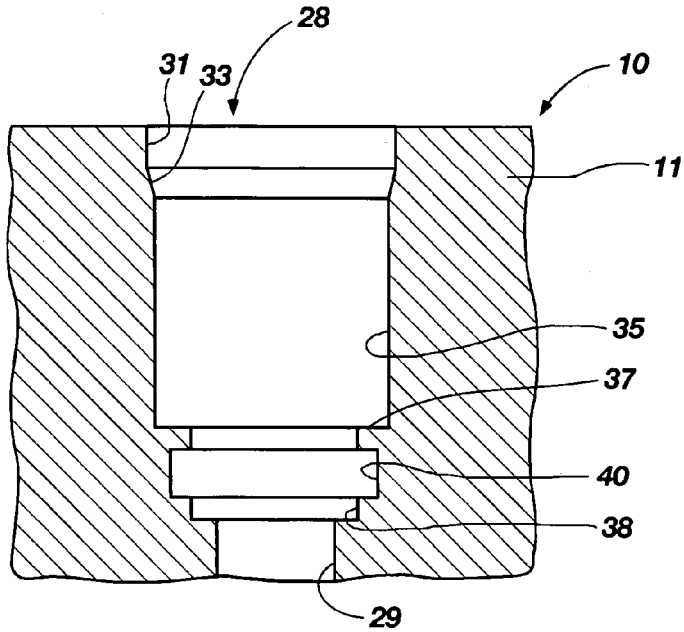
FIG. 3 shows a cross-sectional view of a sleeve port in the drill bit as shown in FIG. 2.
Figure 4:
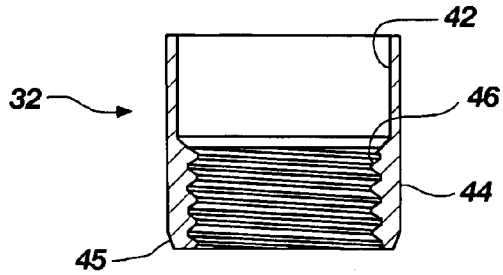
FIG. 4 shows a cross-sectional view of a sleeve as shown in FIG. 2.

FIG. 2 shows a partial cross-sectional view of an embodiment of the nozzle assembly 30. Reference may also be made to FIGS. 1, 3 and 4. The nozzle assembly 30 in this embodiment includes a substantially tubular sleeve 32, a nozzle 34 and an O-ring seal 36 that may be received within a sleeve port 28 of the bit body 11. The sleeve port 28 provides a socket bounded by a substantially cylindrical internal surface in which components of a nozzle assembly 30 are received for communication of drilling fluid from chamber or plenum 29 within the bit body 11 to the face 14 of the drill bit 10. The sleeve 32, which comprises a substantially cylindrical external surface, is mechanically retained within the sleeve port 28 by interference as described below. As shown in FIG. 3, the sleeve port 28 includes within its circumference an exit port 31, a chamfer 33, a sleeve pocket 35, a sleeve seat 37, a seal groove 40, and a body nozzle port 38 and is configured for receiving the nozzle assembly 30. The exit port 31 is configured to be slightly larger than the sleeve pocket 35 to facilitate insertion of the sleeve 32 into the sleeve port 28. Further, the chamfer 33 facilitates alignment and placement of the sleeve 32 as it is coupled into the sleeve pocket 35. The sleeve seat 37 provides a stop for insertion of the sleeve 32 configured to provide determinant depth positioning of the sleeve 32 within the sleeve pocket 35 as it is inserted therein during assembly. The body nozzle port 38 includes a seal groove 40 circumferentially located therein and may receive a seal 36. The seal 36 may provide a barrier as it is compressed between the nozzle 34 and the sleeve port 28 thereby reducing or preventing flow of the drilling fluid around the external periphery of sleeve 32 and thereby mitigating the effects of erosion caused by flow of the drilling fluid resulting from any pressure differential across the nozzle 34.

As shown in FIG. 4, the sleeve 32 includes a nozzle port 42 having internal threads 46 configured for engaging threads 56 of a nozzle 34, as described below, and a cylindrical external surface 44. The external surface 44 includes an insertion chamfer 45 at one end thereof to facilitate insertion of the sleeve 32 into the sleeve pocket 35 of the sleeve port 28. The internal threads 46 of the sleeve 32 provide an improved connection with the nozzle 34 because the sleeve 32 may be machined or cast to precision tolerances, which are difficult to obtain or maintain in the material of a "cemented" or "matrix" bit during its manufacture. Further, the diameter of external surface 44 may be customized easily to a particular size of a sleeve port 28, for example by machining to a particular external dimension, allowing the dimensions of nozzle port 42 to be standardized for receiving nozzles.

The nozzle 34 includes an outer wall 54, external threads 56 on a portion thereof and an internal passageway or bore 57 through which drilling fluid flows from chamber or plenum 29, bore 57 to nozzle orifice 59. The nozzle 34 is removably insertable into the sleeve 32 in coaxially engaging relationship therewith and is retained in the nozzle port 42 of the sleeve 32 by engagement of its external threads 56 with internal threads 46 of sleeve 32. The seal 36 is sized and configured to be compressed between the outer wall of the seal groove 40 of the body nozzle port 38 and the external surface 44 of the sleeve 32 to substantially prevent drilling fluid flow between the sleeve 32 and the wall of the sleeve port 28, while the fluid flows through the nozzle assembly 30. In this embodiment, fluid sealing is provided between the nozzle 34 and the wall of sleeve port 28 below the engaged threads 46 and 56, but the seal may be provided elsewhere along the outer wall 54 of nozzle 34 and wall of the sleeve port 28, between the sleeve 32 and the sleeve port 28 and/or between the nozzle port 42 of the sleeve 32 and the outer wall 54 of the nozzle 34. In this regard, additional seals may also be utilized to advantage as described in U.S. patent application Ser. No. 11/600,304 entitled "Drill Bit Nozzle Assembly, Insert Assembly Including Same and Method of Manufacturing or Retrofitting a Steel Body Bit for Use With the Insert Assembly," assigned to the assignee of this patent application, and the disclosure of which is incorporated by reference herein, and may be utilized in embodiments of the invention.

The sleeve 32 may comprise steel material, as known to those of ordinary skill in the art, to provide retention of the nozzle 34 while securely interfacing with the bit body 11. Optionally, other materials may be used for, or to line, the sleeve 32, such as nonferrous metals and alloys thereof or ceramic materials.

The nozzle 34 may comprise tungsten carbide material, as known to those of ordinary skill in the art, to provide high erosion resistance to the drilling fluids being pumped through the nozzle assembly 30 at a high velocity. Optionally, other materials may be used for, or to line, the nozzle 34, such as other matrix composite materials, steels or ceramic materials.

Cermets may also be selected as a material for the bit body 11, the sleeve 32 and the nozzle 34. Cermets are ceramic-metal composites. One cermet suitable for use with embodiments of the invention is cemented carbide comprising extremely hard particles of a refractory carbide ceramic including tungsten carbide or titanium carbide, embedded in a matrix of metals such as cobalt or nickel alloy or a steel alloy.

Advantageously in this embodiment of the invention, the steel material of the sleeve 32 provides a primary support material suitable for being compressively retained within the "cemented" carbide material of the sleeve port 28 of the bit body 11 while providing differentiated material for attachment with the tungsten carbide material of the nozzle 34. In this regard, the sleeve 32 provides a suitable interface for improving assembly and disassembly of the nozzle 34 without the negative effects associated when using similar materials, such as galling. By providing the sleeve 32, reworking of the internal threads 46 may be accomplished more easily or the sleeve 32 may be removed and replaced without alteration to the bit body 11. Also, the sleeve 32 simplifies attachment and replacement of the nozzle 34 by providing a higher quality engagement surface, i.e., the internal threads 46, within its body.

The seal groove 40 is shown as an open, annular channel of substantially rectangular cross section. However, the seal groove 40 may have any suitable cross-sectional shape. The effectiveness of seal groove 40 may be less affected by dimensional changes caused in the bit body 11 during final sintering because the seal 36 may adequately compensate for such changes by accommodating the resulting structure.

Figure 5:
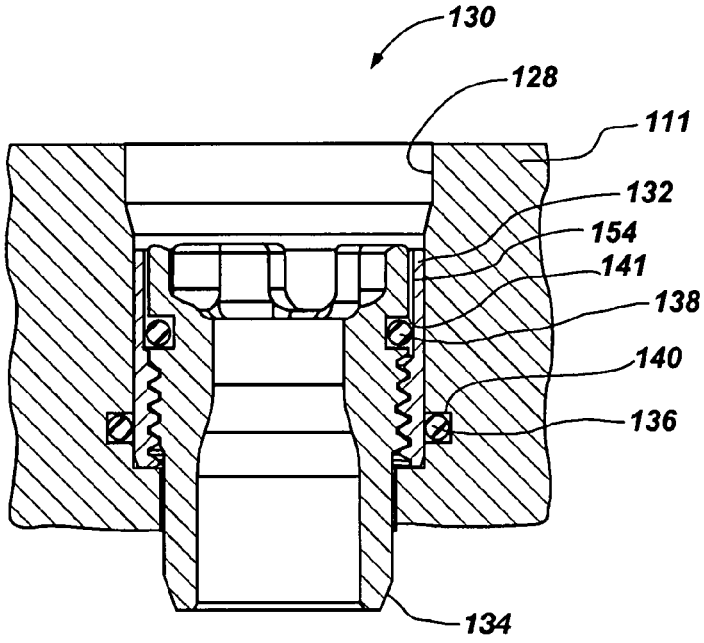
FIG. 5 shows a cross-sectional view of a nozzle assembly in accordance with another embodiment of the invention.

While the seal groove 40 is shown completely located within the material of the bit body 11 surrounding sleeve port 28, it may optionally be located in the outer wall 54 of the nozzle 34 and/or the external surface 44 of the sleeve 32. The seal groove 40 may also be optionally formed partially within the material of the bit body 11 surrounding the sleeve port 28 and partially within the outer wall 54 of the nozzle 34 or the external surface 44 of the sleeve 32, respectively, depending upon the type of seal used. Also, additional seal grooves and seals may optionally be used to advantage. For example, FIG. 5 shows a cross-sectional view of another embodiment of a nozzle assembly 130. The nozzle assembly 130 has a seal groove 140 located in a sleeve port 128 of a bit body 111 and another seal groove 141 located in an outer wall 154 of a nozzle 134, both sized and configured to receive seals 136, 138.

The seal 36 and seals 136 and 138 provide a seal to prevent drilling fluid from bypassing the interior of the sleeve 32, 132 and flowing through any gaps at locations between components to eliminate the potential for erosion while avoiding the need for the use of joint compound, particularly between the threads. The seals 36, 136, 138 may each comprise an elastomer or other suitable, resilient seal material or combination of materials configured for sealing, when compressed, under high pressure within an anticipated temperature range and under environmental conditions (e.g., carbon dioxide, sour gas, etc.) to which drill bit 10 may be exposed for the particular application. Seal design is well known to persons having ordinary skill in the art; therefore, a suitable seal material, size and configuration may easily be determined, and many seal designs will be equally acceptable for a variety of conditions. For example, without limitation, instead of an O-ring seal, a spring-energized seal or a pressure energized seal may be employed. Further, the seal material may be designed to withstand high or low temperatures expected during the assembly process of inserting a sleeve into a bit body.

Figure 6:
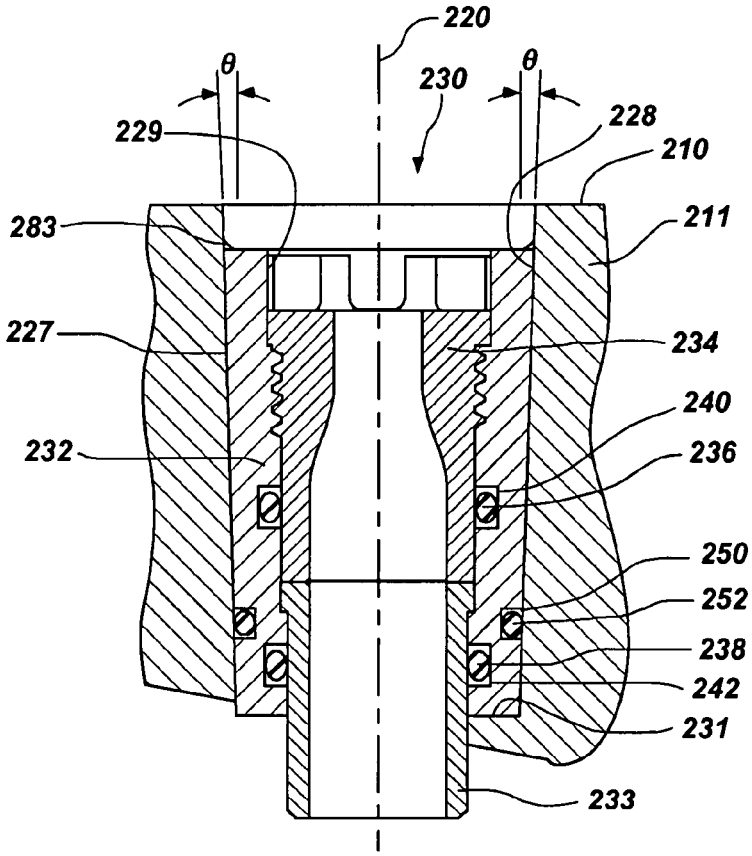
FIG. 6 shows a partial cross-sectional view of a drill bit having a tapered sleeve port sized and configured for compressively retaining a nozzle assembly disposed and secured therewithin in accordance with yet another embodiment of the invention.

Before turning to a method of manufacture, yet another embodiment of the invention as shown in FIG. 6 will now be discussed. FIG. 6 shows a partial cross-sectional view of a steel body drill bit 210 having a tapered sleeve port 228 sized and configured for compressively retaining a nozzle assembly 230 disposed and secured therewithin in accordance with yet another embodiment of the invention. While the drill bit 210 of this embodiment is made from steel material, other materials may be utilized such as "cemented" carbide and "matrix" carbide, for example, as described herein.

The tapered sleeve passage or sleeve port 228 extends linearly inward at a taper angle θ relative to its centerline 220 to form a substantially frustoconical internal surface. The tapered sleeve port 228 is machined into the bit body 211 of the bit 210 to accommodate the nozzle assembly 230, which includes an optional inlet tube 233 of the nozzle assembly 230 to extend into the fluid cavity of the bit 210. The tapered sleeve port 228 may desirably include a smaller counterbore (not numbered) at the lower end thereof bounded by shoulder 231. Optionally, the shoulder 231 may allow for determinant positioning of a sleeve 232 of the nozzle assembly 230 during a shrink fit assembly of the sleeve 232 within the tapered sleeve port 228 and may be used to advantage with other embodiments of the invention. In this embodiment, the sleeve 232 includes a mating taper upon its outer cylindrical wall 227 forming a substantially frustoconical external surface that is configured and dimensioned to allow the sleeve 232 to be inserted into position within the tapered sleeve port 228 while a temperature differential between the parts exists. In this regard, the sleeve 232 may be determinately longitudinally positioned and radially compressively retained within the tapered sleeve port 228 as the temperature between them equalizes. Also, the optional step of the shoulder 231 may be used in conjunction with the tapered sleeve port 228 when positioning the sleeve 232 therein, in order to allow greater temperature differentials between the bit body 211 and the sleeve 232 to be obtained while obtaining a specified interference fit as the temperature then equalizes. Once the sleeve 232 of the nozzle assembly 230 is compressively located within the tapered sleeve port 228, it may be further secured within the tapered sleeve port 228 by an optional continuous weld bead 283 contacting sleeve 232 and the wall of tapered sleeve port 228. Optionally, the nozzle assembly 230 may be secured by spot welding in a similar manner, without limitation, as would be recognized by a person having skill in the art. It is to be recognized that the retention of the sleeve 232 within the tapered sleeve port 228 is by compressive interference fit which should adequately retain the sleeve 232 therein while under the influence of hydraulic pressures caused by the flow of fluid therethrough, and that while the optional weld bead 283 will further increase the safety factor for retention of the parts when required, unavoidably the weld bead 283 will hinder repair and retrofitting thereof. Moreover, the taper angle θ without the optional weld bead 283 will be limited to the extent that the retention strength of sleeve 232 attributable to the radially acting compressive force between the sleeve 232 and the bit body 211 exceeds the force of drilling fluid pressure acting longitudinally thereon.

Further, an optional sleeve seal 252 and a seal groove 250 may be desirably included between the outer cylindrical wall 227 of the sleeve 232 and the wall of the tapered sleeve port 228 in order to prevent undesirable washing or fluid flow should the compressive fit fail to provide a continuous annular seal therebetween. The optional sleeve seal 252 in this embodiment would be of a material suitable for continuous duty temperatures experienced during down hole drilling while withstanding the temperature extremes expected during the shrink-fit coupling of the sleeve 232 within the body 211. The material of the sleeve seal may include, without limitation, any elastomeric material where the thermal degradation due to temperature extremes during the shrink-fit coupling doesn't render its physical properties inoperative. The material of the sleeve seal may also include other natural material and metals, without limitation.

The nozzle assembly 230 includes a sleeve 232, an inlet tube 233, a nozzle 234, three O-rings 236, 238, 252 and seal grooves 240, 242, 250. The sleeve 232 includes an interior bore 229 and the outer cylindrical wall 227. The outer cylindrical wall 227 is sized to be compressively received within the tapered sleeve port 228 of the drill bit 210. The wall of interior bore 229, in this embodiment, includes the seal grooves 240, 242 and 250, as mentioned herein, receives the inlet tube 233, the nozzle 234, and the O-rings 236 and 238. Additional elaboration is not necessary regarding the internal components of the nozzle assembly 230 or their manner of disposition within sleeve 232, as the details of such disposition as well as various options and embodiments of the structure thereof are described above and in particular in the reference disclosed herein. The nozzle assembly 230 is suitable for retrofitting an existing bit or when repair or refurbishment is required. When a new drill bit is being manufactured, it is anticipated that the embodiments of the invention mentioned herein may be utilized.

In embodiments of the invention the sleeve may be secured within the sleeve port by bonding. Bonding may be accomplished by utilizing adhesives, soldering, brazing and welding, for example, without limitation. When the sleeve is secured by bonding into the bit body, the bond must be able to withstand continuous operating conditions typically encountered that include high pressure, pulsating pressure and temperature changes.

A method of manufacturing or retrofitting a drill bit for mechanically retaining a nozzle assembly as shown in the embodiments given above is now discussed. The method of manufacturing or retrofitting includes providing a sleeve port in a bit body, providing a temperature differential between the bit body and a sleeve of the nozzle assembly, receiving the sleeve into the sleeve port while substantially maintaining the temperature differential therebetween and retaining the sleeve therein by equalizing the temperatures of the bit body and the sleeve. It is to be recognized that in order to mechanically retain the sleeve within the bit body, the sleeve will necessarily have a greater circumference on its cylindrical external surface than the inner circumference of the sleeve port of the bit body at ambient temperature and over any anticipated operating temperature range to which the drill bit may be exposed. In at least one embodiment, the circumference on the cylindrical external surface of the sleeve is approximately three to five thousandths of an inch (0.003-0.005") (0.0000762-0.000127 meter) greater in diameter than the inner diameter of the sleeve port of the body when both parts are at ambient temperature. In other embodiments, the circumference on the cylindrical external surface of the sleeve may range from two to seven thousandths of an inch (0.002-0.007") (0.0000508-0.000127 meter) greater in diameter than the inner diameter of the sleeve port of the body when both parts are at ambient temperature. In yet other embodiments, the circumference of the cylindrical external surface may range from one to ten thousandths of an inch (0.0001-0.010") (0.0000254-0.000254 meter) greater. In still other embodiments, the relatively greater circumference on the cylindrical external surface of the sleeve may also range from a lesser or greater extent than the one to ten thousandths of an inch described. Of course, the foregoing relative diametrical dimensional relationships between transverse cross-sections of the sleeve and the sleeve port also apply in the case of a frustoconical sleeve and sleeve port combination.

According to embodiments of the invention, providing a sleeve port in a bit body may be accomplished by machining the sleeve port in the bit body. For example, if the bit body is manufactured from a steel billet, the sleeve port may be easily machined to size and configured for compressively receiving a sleeve. As another example, if the bit body is manufactured in the form of a "cemented" material, the sleeve port may be machined into the soft "brown" or "green" body prior to final sintering. An optional dowel or displacement may then be placed into the sleeve port to accurately define the outside diameter of the sleeve port during final sintering, which is then subsequently removed. After final sintering the sleeve may be received into the sleeve port as mentioned above. To facilitate placement and depth positioning of the sleeve of the nozzle assembly, determinant positioning features as indicated above may be included within the sleeve port of the bit body.

Providing a temperature differential between the bit body and the sleeve of the nozzle assembly may be accomplished by heating the bit body or cooling the sleeve, or both heating the bit body and cooling the sleeve. The required temperature differential between the bit body and the sleeve to both enable insertion of the sleeve within the body and provide a sufficient sleeve retention force will depend upon the thermal expansion coefficient of the particular material chosen for each part and the degree to which an interference fit is required, as is known to those of ordinary skill in the art. In order to save time and energy cost when manufacturing a "cemented" carbide bit, insertion of the sleeve may be accomplished, for example, while the bit body is hot, i.e., 800 ° F., for example, from brazing the cutters onto the bit body. Prior to the insertion of the sleeve into the bit body, the sleeve may also be chilled with liquid nitrogen, in a subzero chiller or by other means known in the art just before insertion of the sleeve into the sleeve port of the high temperature bit body, thereby providing a wider degree of temperature differential between the parts at the time of insertion. After the sleeve is inserted into the bit body, the bit body is allowed to be cooled, and the sleeve to warm, which contracts the material of the bit body onto the sleeve and expands the sleeve, providing the desired interference fit.

Figure 7:
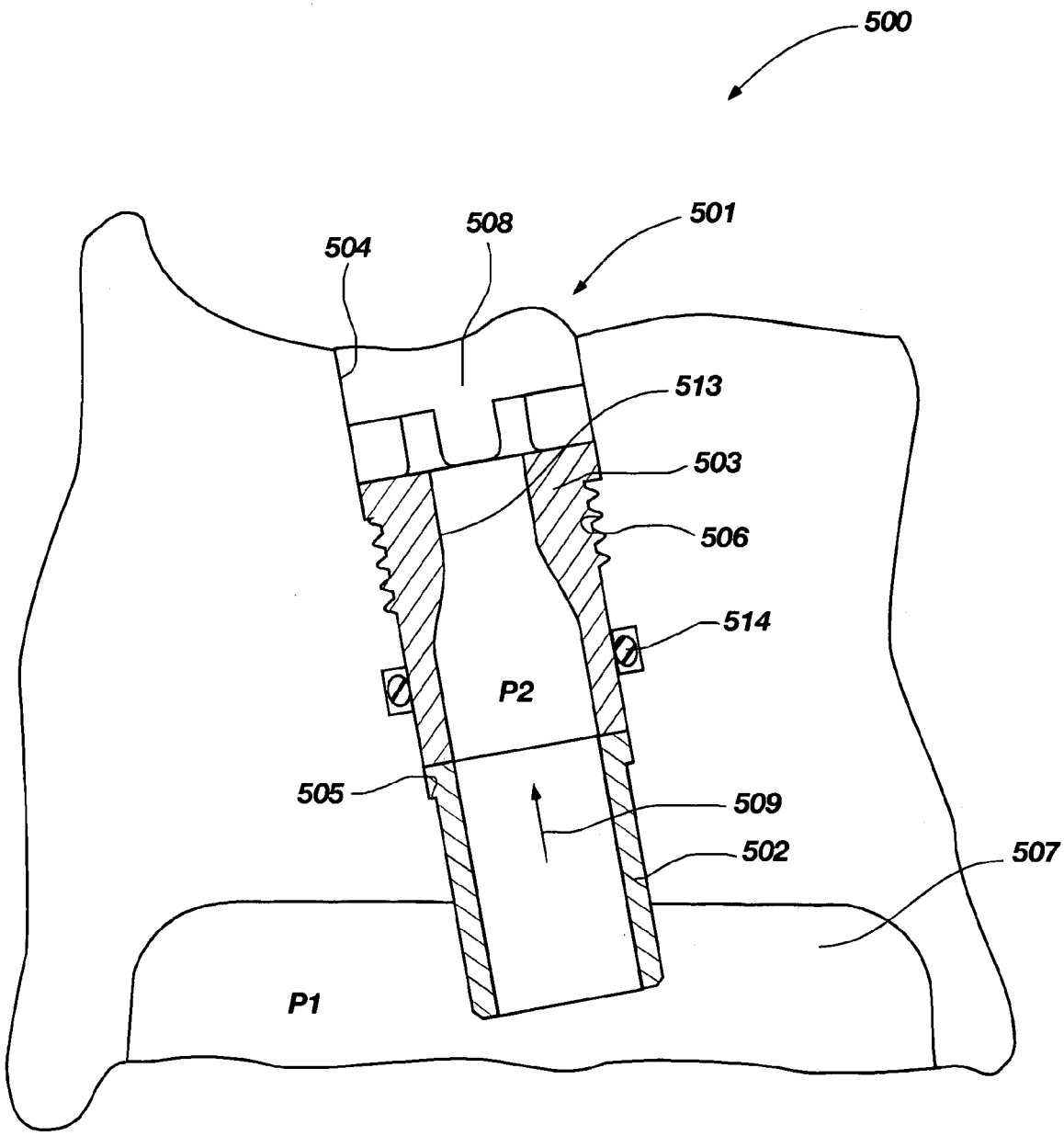
FIG. 7 (PRIOR ART)
FIG. 7 shows a conventional nozzle assembly for a steel body drill bit.

Optionally, if the cylindrical external surface of the sleeve or the wall of the sleeve port includes a seal groove, then an O-ring or other seal may be inserted within the respective seal groove prior to receiving the sleeve into the sleeve port. Also, after the sleeve is retained within the sleeve port, the O-rings or other seals, as well as the optional inlet tube (as described in FIG. 7), and nozzle of erosion-resistant material may then be assembled into the sleeve, and the threads on the nozzle engaged and mate up with the threads on the nozzle port of the sleeve. Subsequently, the sleeve, nozzle, inlet tube and O-rings or other seals may be replaced as necessary or desirable, as in the case wherein a nozzle may be changed out for one with a different orifice size.

An advantage of embodiments of the invention is that a threaded nozzle may be utilized with a drill bit without having the quality problems conventionally associated with machining a sintered body to form or dimensionally refine threads therein or unacceptable dimensional tolerances that often arise in bit bodies that are fabricated out of unsintered or partially sintered tungsten carbide billets and then sintered to final density. Another advantage of embodiments of the invention is that the sleeve improves the ease by which threads on the internal diameter of the nozzle port may be replaced when damaged by replacement of the sleeve, without the dimensional sensitivities associated with threads directly machined into the "cemented" carbide body.

Embodiments of the invention may further include a feature to enhance retention of a sleeve within a sleeve port. Specifically, small particles may be distributed between two substantially cylindrical parts that are to be coupled together by mechanical or interference fit. The small particles, which may be introduced upon either part when a temperature differential between the parts exists as noted above, lock the two parts together in order to provide an additional mechanical interference of their interfacial areas and to change the retention strength of the two interfering parts. The small particles may be of any size suitable for providing interlocking between the two interfering parts, but must be small enough not to interfere with the assembly of the two parts while a temperature differential exists between both parts. In one aspect, the small particles form a mechanical lock, or interface along the boundary between the two interfering parts. The density, shape, and size of the small particles will depend upon the retention strength desired, the composition of both parts to be mutually secured, the degree of interference between the two parts and the composition of the small particles. In the most basic application, either part may be coated with a fine particulate prior to assembly of the temperature-differentiated parts, after which the parts are assembled and allowed to equalize in temperature in order to provide an enhanced mechanical or interference fit. The particulate may be deposed on the mating surfaces either as a dry powder or as a slurry wherein the abrasive particulate is mixed with a carrier fluid such as, for example, water, oil, alcohols, polyols or other organic or silicon based fluids. The particles may penetrate the surfaces of the two joined parts after normalization of their temperatures to provide additional retention force against mutual longitudinal displacement of one relative to the other.

One of the embodiments of the invention may include particles (not shown) with a fifty micron (0.00005 meter) silicon carbide (SiC) grit. The SiC grit is harder than the steel material of the sleeve 32 and the "cemented carbide" material of the sleeve port 28 in the bit body 11. When the sleeve 32 is interferingly fit within the sleeve port 28, the SiC grit will provide additional mechanical locking therebetween while increasing the retention strength of the sleeve 32 within the sleeve port 28. The increase in retention strength will provide an additional margin of safety, particularly when the drill bit 10 is subjected to pulsating pressures of the drilling fluid flow while drilling.

It is to be recognized that such particulates may be used to mutually secure other cylindrical parts wherein enhanced retention strength is desired. In this regard, such an embodiment of the invention is not limited to the modality of nozzle assemblies or drill bits. Also, while one of the embodiments of the invention employs particles of SiC grit, other particles such as metals, metal oxides, carbides, borides, and nitrides, including, but not limited to, alumina, silica, zirconia, boron nitride, boron carbide, aluminum nitride, magnesium oxide, calcium oxide, and diamond may be utilized to advantage.

Optionally, the particulate may range in size as based upon the percentage of available gap achieved during the interference assembly. In this regard, the particulate may range between 1% and 95% of the available gap size. As an example for a fifty micron (0.00005 meter) silicon carbide (SiC), the SiC particulate ranges between about 40% and 98% in size when the available gap size ranges between two thousandths (0.002") of an inch (0.0000508 meter) and five thousandths (0.005") of an inch (0.000127 meter), respectively.

In order to facilitate a more even dispersion of the particles, a carrier fluid may be used in order to apply the particles upon either of the two interfacial areas of the parts. The particles may be suspended in a carrier fluid such as an alcohol, and then applied to either of the parts; preferably the cooler of the two parts and then assembled as noted above. The carrier fluid enables an improved or more uniform coverage of the particles upon the interfacial areas of the parts. The carrier fluid should be selected so as to not influence the interference fit. In embodiments of the invention, the carrier fluid will be desirably dissipated, as by vaporization or combustion, for example, without limitation, when exposed to the higher temperature part while the parts begin to equalize in temperature.

While particular embodiments of the invention have been shown and described, numerous variations and other embodiments will occur to those skilled in the art. Accordingly, it is intended that the invention be limited in terms of the appended claims.

What is claimed is:

1. A shrink-fit sleeve assembly for a drill bit for subterranean drilling, the shrink-fit sleeve assembly comprising:

a bit body comprising at least one sleeve port of substantially circular cross-section therein, the at least one sleeve port having an internal surface;

a substantially tubular sleeve of substantially circular cross-section disposed in and solely interferingly engaged with the at least one sleeve port of the bit body, the tubular sleeve comprising an internal nozzle port having threads on a wall of the internal nozzle port of the tubular sleeve and having an external surface of substantially circular cross-section having a lateral dimension equal to or greater than a lateral dimension of the internal surface along an identical cross-section prior to disposition interferingly into the at least one sleeve port when at ambient temperature, the external surface of the tubular sleeve having a chamfer thereon for insertion of the tubular sleeve into the at least one sleeve port; and a substantially tubular nozzle comprising an erosion-resistant material and disposed in the internal nozzle port having threads on an outer wall of the tubular nozzle engaged with the threads on the wall of the internal nozzle port, a portion of the tubular sleeve extending from an upper end of the tubular nozzle to the threads on the outer wall of the tubular nozzle.

2. The shrink-fit sleeve assembly of claim 1, wherein the lateral dimension of the external surface is between approximately three thousandths and approximately five thousandths of an inch greater than the lateral dimension of the internal surface prior to disposition interferingly into the at least one sleeve port when at ambient temperature.

3. The shrink-fit sleeve assembly of claim 1, further comprising an annular groove formed in at least one of the at least one sleeve port and the external surface of the tubular sleeve laterally adjacent the at least one sleeve port, and at least one annular seal disposed in the annular groove.

4. The shrink-fit sleeve assembly of claim 1, further comprising an annular groove formed in at least one of the outer wall of the tubular nozzle laterally adjacent a wall of the internal nozzle port of the tubular sleeve, a wall of the internal nozzle port of the tubular sleeve laterally adjacent the outer wall of the tubular nozzle and the outer wall of the tubular nozzle laterally adjacent a wall of the at least one sleeve port, and at least one annular seal disposed in the annular groove.

5. The shrink-fit sleeve assembly of claim 1, further comprising a substantially tubular nozzle comprising an erosion-resistant material and disposed in the internal nozzle port proximate an exterior surface of the bit body, and a substantially tubular inlet tube comprising an erosion-resistant material and disposed in the internal nozzle port in a longitudinally adjacent substantially abutting relationship to the tubular nozzle.

6. The shrink-fit sleeve assembly of claim 5, further comprising an annular groove formed in at least one of a wall of the at least one sleeve port laterally adjacent an outer wall of the tubular nozzle, the outer wall of the tubular nozzle laterally adjacent a wall of the internal nozzle port of the tubular sleeve, a wall of the internal nozzle port of the tubular sleeve laterally adjacent the outer wall of the tubular nozzle, an outer wall of the tubular inlet tube laterally adjacent a wall of the internal nozzle port of the tubular sleeve, a wall of the internal nozzle port of the tubular sleeve laterally adjacent the outer wall of the tubular inlet tube and the outer wall of the tubular inlet tube laterally adjacent a wall of the at least one sleeve port, and the at least one annular seal disposed in the annular groove.

7. The shrink-fit sleeve assembly of claim 1, wherein the bit body comprises a material selected from the group consisting of a metal alloy, a ceramic, and a cermet, and the tubular sleeve comprises a material selected from the group consisting of a metal alloy, a ceramic, and a cermet.

8. The shrink-fit sleeve assembly of claim 1, wherein the bit body comprises a tungsten carbide in a matrix of a cobalt or nickel alloy, and the tubular sleeve comprises a steel.

9. The shrink-fit sleeve assembly of claim 1, wherein the at least one sleeve port of the bit body further includes a determinant position feature for limiting a depth of insertion of the substantially tubular sleeve into the at least one sleeve port.

10. The shrink-fit sleeve assembly of claim 9, wherein the determinant position feature is selected from the group consisting of an annular sleeve seat within the at least one sleeve port, a shoulder within the at least one sleeve port, a step within the at least one sleeve port and cooperatively tapered internal and external surfaces.

11. The shrink-fit sleeve assembly of claim 1, wherein the internal surface is substantially cylindrical, the lateral dimension thereof comprises the diameter of the internal surface, the external surface is substantially cylindrical, and the lateral dimension thereof comprises the diameter of the external surface.

12. The shrink-fit sleeve assembly of claim 1, wherein at least a portion of an internal surface of the at least one sleeve port is substantially frustoconical and extends linearly inward at a first taper angle in the bit body and at least a portion of the external surface of the tubular sleeve is substantially frustoconical and extends linearly inward at a similar, second taper angle.

13. The shrink-fit sleeve assembly of claim 12, wherein the first taper angle and the second taper angle are substantially the same.

14. A nozzle assembly for a drill bit for subterranean drilling, the nozzle assembly comprising:

a bit body comprising at least one sleeve port of substantially circular cross-section therein, the at least one sleeve port having an internal surface;

a substantially tubular sleeve disposed in and solely interferingly engaged with the at least one sleeve port of the bit body, the tubular sleeve comprising an internal nozzle port having threads on an interior wall of the internal nozzle port and an external surface of substantially circular cross-section, the external surface having a lateral dimension equal to or greater than a lateral dimension of the internal surface along an identical cross-section prior to disposition interferingly into the at least one sleeve port when at ambient temperature, the external surface of the tubular sleeve having a chamfer thereon for the insertion of the tubular sleeve into the at least one sleeve port; and a tubular nozzle comprising an erosion-resistant material and disposed in the internal nozzle port, the tubular nozzle having threads on an outer wall of the tubular nozzle engaged with the threads on the interior wall of the internal nozzle port, having a portion of the tubular sleeve extending from an upper end of the tubular nozzle to the threads on the outer wall of the tubular nozzle.

15. The nozzle assembly of claim 14, wherein the tubular nozzle disposed in the internal nozzle port is proximate an exterior surface of the bit body, and further comprising a substantially tubular inlet tube comprising an erosion-resistant material and disposed in the internal nozzle port in a longitudinally adjacent substantially abutting relationship to the tubular nozzle.

16. The nozzle assembly of claim 14, wherein the lateral dimension of the external surface is between approximately one thousandth and approximately ten thousandths of a unit length per unit of lateral dimension length greater than the lateral dimension of the internal surface.

17. The nozzle assembly of claim 14, further comprising an annular groove formed in at least one of a wall of the at least one sleeve port laterally adjacent the external surface of the tubular sleeve, the external surface of the tubular sleeve laterally adjacent a wall of the at least one sleeve port, the outer wall of the tubular nozzle laterally adjacent a wall of the internal nozzle port of the tubular sleeve, a wall of the internal nozzle port of the tubular sleeve laterally adjacent the outer wall of the tubular nozzle and the outer wall of the tubular nozzle laterally adjacent a wall of the at least one sleeve port, and at least one annular seal disposed in the annular groove.

18. The nozzle assembly of claim 17, wherein the bit body comprises a tungsten carbide in a matrix of a cobalt or nickel alloy, and the tubular sleeve comprises steel, the erosion-resistant material of the tubular nozzle comprises a tungsten carbide and a cobalt matrix, and the at least one annular seal comprises at least one elastomer.

19. The nozzle assembly of claim 14, wherein the at least one sleeve port of the bit body further includes a determinant position feature for limiting a depth of insertion of the substantially tubular sleeve into the at least one sleeve port.

20. The nozzle assembly of claim 19, wherein the determinant position feature is selected from the group consisting of an annular sleeve seat within the at least one sleeve port, a shoulder within the at least one sleeve port, a step within the at least one sleeve port and cooperatively tapered internal and external surfaces.

21. The nozzle assembly of claim 14, wherein the internal surface is substantially cylindrical, the lateral dimension thereof comprises the diameter of a internal surface, the external surface is substantially cylindrical, and the lateral dimension thereof comprises the diameter of the external surface.

22. The nozzle assembly of claim 14, wherein at least a portion of an internal surface of the at least one sleeve port is substantially frustoconical and extends linearly inward at a first taper angle in the bit body and at least a portion of the external surface of the tubular sleeve is substantially frustoconical and extends linearly inward at a similar, second taper angle.

23. The nozzle assembly of claim 22, wherein the first taper angle and the second taper angle are substantially the same.

24. The nozzle assembly of claim 14, further comprising particulate material disposed between an internal surface of the at least one sleeve port of the bit body and the external surface of the substantially tubular sleeve, wherein the particulate material comprises cermet or ceramic particles.

25. The nozzle assembly of claim 24, wherein a size of the cermet or ceramic particles is between 1% and 95% of an available gap size between the tubular sleeve and the at least one sleeve port of the bit body, the available gap size being between one thousandth (0.001") and ten thousandths (0.010") of an inch prior to the tubular sleeve being disposed in and interferingly engaged with the at least one sleeve port of the bit body.

26. The nozzle assembly of claim 14, further comprising particulate material disposed between an internal surface of the at least one sleeve port of the bit body and the external surface of the substantially tubular sleeve, wherein the particulate material comprises silicon carbide.

27. The nozzle assembly of claim 14, further comprising particulate material disposed between an internal surface of the at least one sleeve port of the bit body and the external surface of the substantially tubular sleeve, wherein the particulate material disposed between the internal surface of the sleeve port of the bit body and the external surface of the substantially tubular sleeve comprises residue of a carrier fluid used to suspend the particulate material prior to disposition interferingly into the at least one sleeve port.

28. The nozzle assembly of claim 25, wherein the cermet or ceramic particles have a particle size of about fifty microns.

* * * * *

UNITED STATES PATENT AND TRADEMARK OFFICE

CERTIFICATE OF CORRECTION

PATENT NO. : 7,681,668 B2
APPLICATION NO. : 11/731245
DATED : March 23, 2010
INVENTOR(S) : James Andy Oxford et al.

It is certified that error appears in the above-identified patent and that said Letters Patent is hereby corrected as shown below:

In the claims:

CLAIM 21, COLUMN 14, LINE 52, change “a internal” to --the internal--

Signed and Sealed this
Twenty-third Day of July, 2013

Teresa Stanek Rea
*Acting Director of the United States Patent and Trademark Office*